United States Patent [19]

Harreld et al.

[11] Patent Number: 4,486,975

[45] Date of Patent: Dec. 11, 1984

[54] INFLATABLE NOVELTY DEVICE

[75] Inventors: Donald R. Harreld, Antioch, Ill.; Martin G. Wiessner, Oregon, Wis.

[73] Assignee: Vonco Products, Inc., Lake Villa, Ill.

[21] Appl. No.: 531,056

[22] Filed: Sep. 12, 1983

[51] Int. Cl.[3] ..... A63H 3/06

[52] U.S. Cl. ..... 446/220; 2/158

[58] Field of Search ..... 46/87, 88, 154; 2/18, 2/158, 16; 273/26 C, 26 R, 58 B; 40/538, 586

[56] References Cited

U.S. PATENT DOCUMENTS

| | | | |
|---|---|---|---|
| 1,453,715 | 5/1923 | Levinson | 2/18 |
| 2,487,546 | 11/1949 | Harrowe | 46/28 |
| 2,586,608 | 2/1952 | Bryson | 2/158 X |
| 2,916,849 | 12/1959 | Lemelson | 46/88 |
| 3,247,520 | 4/1966 | Slizus | 2/18 |
| 4,218,780 | 8/1980 | Growe et al. | 2/199 |

*Primary Examiner*—Mickey Yu

*Attorney, Agent, or Firm*—Thomas W. Speckman

[57] ABSTRACT

An inflatable novelty device of multiple flexible sheets sealed in regions to form a hollow inflatable peripheral body member in a general horseshoe configuration, the central portion forming a non-inflatable hand pocket cavity. Inflatable outwardly extending appendages may be contiguous with the inflatable peripheral body portion to provide shapes representing "No. 1", "V for victory" and the like. The inflated novelty devices may be worn on one or both hands and still allow clapping and other use of the hand or hands by the wearer. Such novelty devices are used at a wide variety of promotional events, sporting events, political conventions, and the like.

14 Claims, 5 Drawing Figures

INFLATABLE NOVELTY DEVICE

BACKGROUND OF THE INVENTION

1. Field of the Invention

This invention relates to inflatable novelty devices for use as promotional devices, such as for use at sporting events, political conventions and the like, and for toys. The novelty devices of this invention can be generally described as an inflatable peripheral body member with a central non-inflatable pouch for insertion of an individual's hand. The inflatable novelty of this invention provides the user an improved means to express himself by providing a large inflated portion for high visability while still allowing clapping of the hands with the novelty device on one or both hands.

2. Description of the Prior Art

In past years, a variety of promotional novelties have been used such as pins, hats, shirts, helments, banners and the like. These novelties generally depicted the supported individual or team or supportive expressions and may be decorated with a suitable logo or slogan and team colors.

In recent years spectators' interest in promoting individuals or teams has grown considerably. Today, auditoriums, sports arenas and stadiums are built to accommodate larger numbers of spectators. Also, expanded television coverage of spectator events now reaches millions of home viewing spectators.

Today, because the vast majority of spectators are physically isolated and unable to express their support, verbally, among themselves or with the individuals or team members they support, or with home viewing spectators, various forms of non-verbal means of communication have evolved. In recent years, efforts have been made to promote novelty items to allow the spectator to better communicate, visually as well as verbally, his or her support and enthusiasm at various events.

One such novelty device is a polymeric foam device of construction outlining the image of an oversized hand which has an index finger raised in an upright fashion and the balance of the fingers clinched in a fist formation. The spectator utilizes this promotional novelty device by displaying it in a prominent location or by raising it over his head and waving it, to symbolize that his team is "No. 1". However, such devices are passive devices and do not adequately express the spectator's active enthusiasm. Promotional novelties of this type are bulky and cause difficulty for the spectator to transport them to and from the events and to find adequate space for their storage and use at a crowded event. Also, because of their bulkiness, novelties of this type are often damaged through use, transport, or storage. Some such promotional novelties the user must hold with one or both hands in a clinched fist fashion which causes fatigue to the hand, wrists and arms over prolonged use or the user must place a hand in a slit in the body of the device. The requirement of holding the novelty in these fashions limits or eliminates the use of the hand or hands for other general purposes, such as clapping.

SUMMARY OF THE INVENTION

This invention relates to an inflatable novelty device or toy constructed from multiple sheets of puncture resistant flexible material, such as polyethylene, the sheets being of the same size and shape. The sheets of flexible material are sealed to one another at edge regions to provide a hollow inflatable peripheral body member in a general "horseshoe" or inverted U configuration. In the central portion of the hollow inflatable peripheral body, the flexible sheets form a hand pocket cavity which is not inflatable and is open between the legs of the inflatable peripheral body. Access to the hand cavity is through an opening between the flexible sheets of the central portion region outlined by the inflatable peripheral body member.

Inflatable appendanges may be integrally connected to the peripheral body member to extend outwardly therefrom to portray various geometrical configurations, such shapes to include for example, an index finger extended singularly to represent "No. 1" or an extended index finger in combination with an extended middle finger to form a "V" to represent "Victory". These shapes may be in the shape of well known objects relating to the sporting event, such as baseball mits and the like. The novelty devices of this invention may be a wide variety of sizes.

The inflatable novelty devices of this invention may be inflated and deflated by use of any suitable valve means known to the art wherein air or other gas may be introduced to the peripheral body member by any suitable means. Generally, the inflatable devices may be inflated by an individual blowing into the valve means in the same manner as blowing up a balloon. When inflated, the peripheral body member and its appendages are sufficiently rigid to maintain their desired erect position. After use, the novelty device of this invention may be deflated for transport and storage as flexible flat sheets which may be folded into small sizes. The inflatable novelty device may be reused any number of times simply by reinflating.

In use, the inflatable novelty device may be placed over the user's hand by insertion of the hand into the hand pocket cavity. The hand pocket being constructed of flexible sheet material and being non-inflated allows the user to use his hands as for example, clapping, while the novelty device is in place. The flexible sheet material forming the hand pocket may be perforated to provide a means to ventilate the hand pocket cavity, enhancing heat removal and reducing hand perspiration.

Accordingly, it is one object of this invention to provide an inflatable novelty device constructed of flexible sheet materials, forming an inflatable peripheral member with appendages surrounding a hand pocket cavity for hand placement for visibly communicating various emotions.

It is another object of this invention to provide an inflatable novelty device which may be deflated for transportation and storage and may be reinflated for use.

It is yet another object of this invention to provide a hand-held inflatable novelty device constructed in such fashion so as not to inhibit the user from clapping his hands.

It is still another object of this invention to provide a lightweight inflatable novelty device, the construction of which results in flexibility providing safety to others who may accidentally come into contact with the novelty device.

BRIEF DESCRIPTION OF THE DRAWING

These and other objects of this invention will become more apparent from the description of the preferred embodiments and drawings appended hereto in which.

DESCRIPTION OF THE PREFERRED EMBODIMENTS

Figure 1:
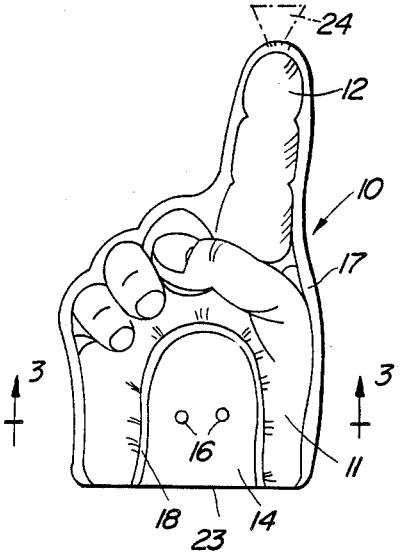
FIG. 1 shows a front view of an inflatable sporting novelty of one embodiment of this invention.
Figure 2:
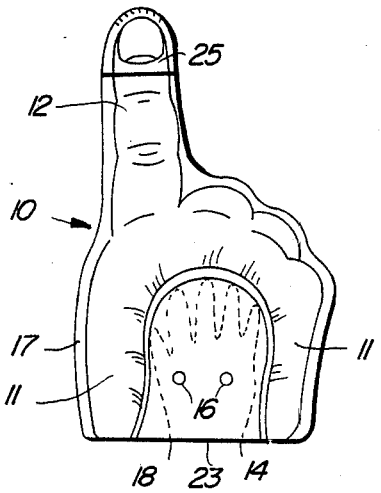
FIG. 2 is a rear view of the device shown in FIG. 1.
Figure 3:
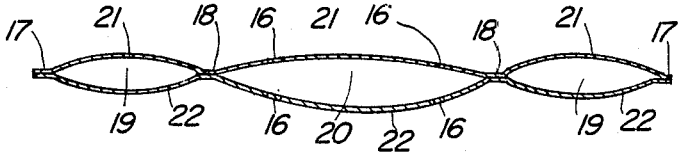
FIG. 3 is a sectional view along line 3—3 shown in FIG. 1.

Referring to FIGS. 1–3, the inflatable novelty device 10 may be generally described as being constructed of two sheets of lightweight, flexible material, such as puncture resistant polyethylene. A front sheet 21 and an identical rear sheet 22 having the desired outer shape are sealed together at their outer periphery with peripheral edge seal 17 and continuous therewith inner edge seal 18 to form peripheral inflatable cavity 19. Peripheral inflatable cavity 19 is continuous with peripheral inflatable extension 12. Inner edge seal 18 defines central non-inflatable hand pocket 14 having central hand pocket cavity 20 with open end 23. The exterior of the sheets may have multiple coloration and other printing. The dimensional size of the novelty device may vary according to the desired size and the shape sought to depict.

Figure 4:
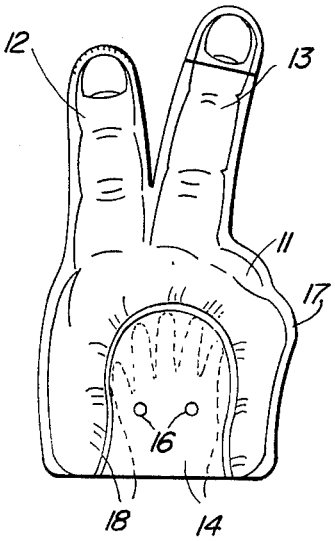
FIG. 4 shows another embodiment of an inflatable sporting novelty of this invention.
Figure 5:
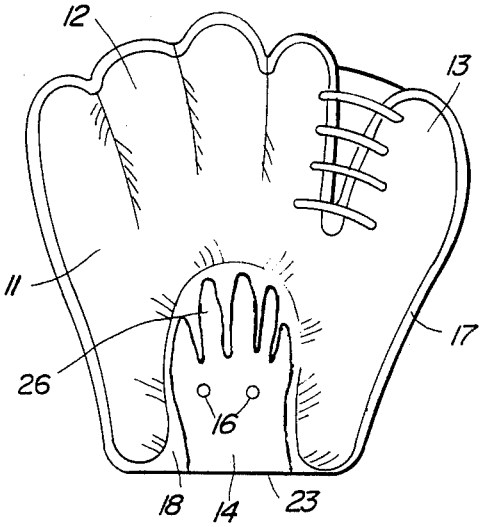
FIG. 5 shows another embodiment of an inflatable sporting novelty of this invention.

Any means known to the art may be utilized to form continuous peripheral edge seal 17 and inner edge seal 18 between front flexible sheet 21 and rear flexible sheet 22 to form an air-tight peripheral body 11 defining peripheral inflatable cavity 19 of general "horseshoe" geometry and having appendage extension 12, shown in FIGS. 1 and 2 as an index finger. The seals are generally heat seals as well known to the art. The outer periphery of FIG. 1 together with printed markings depicts a hand with a clenched fist and elevated forefinger indicating "Number One". FIG. 4 shows a hand with a clenched fist with the forefinger and middle finger parted in a "V" formation, and FIG. 5 shows a baseball glove.

Front flexible sheet 21 and rear flexible sheet 22, in the area between the legs of the inverted U form a central non-inflatable hand pocket 14. Hand pocket 14 is defined by inner edge seal 18 and open end 23 providing central hand pocket cavity 20 for insertion of a hand, shown dotted, for holding the novelty device. The geometrical configuration of hand pocket cavity 20 may be modified to form various other shapes, for example, as shown in FIG. 5, a glove formation providing individual finger cavities 26. The hand is placed into the hand pocket cavity 20 through open end 23. The front and/or rear flexible sheet material webs forming hand pocket 14 may be perforated with ventilation holes 16. As many such ventilation holes as desired may be used to provide for heat dissipation radiating from the hand while this novelty is being used, provided the structural integrity of the sheets is maintained.

Any suitable inflation-retention-deflation means known to the art may be used for inflation, retention of inflation fluid, and deflation of peripheral inflatable body 11 may be used. One especially suitable inflation-retention-deflation means which is self-tightening upon application of external pressure to the inflated article is disclosed in allowed U.S. patent application entitled "Plastic Bags Having a Pressure Resistant Closure", Ser. No. 232,139, filed Feb. 6, 1981 by Louis L. Laske and Donald R. Harreld, now U.S. Pat. No. 4,408,643, the disclosure of which is incorporated herein by reference. Multiple inflation-retention-deflation means, that is, a combination of valves or closures may be used. The inflation-retention-deflation means may be located at any suitable location in peripheral inflatable body 11. As shown in FIG. 1, inflation-retention-deflation means 24 is conveniently located at the tip of extension 12. Using a closure of the type disclosed in the above identified patent application, the closure may be completely enclosed in a closure pocket 25 as shown in FIG. 2. To inflate peripheral inflatable body 11, air or other gaseous material, such as helium, may be blown into peripheral inflatable cavity 19 which includes any extending appendages. As gas is introduced to cavity 19, the gas pressure against the cavity walls of peripheral inflatable body 11 and its appendages increase. This internal gas pressure causes flexure of the walls outwardly forming a three dimensional shape sufficiently rigid to support itself.

The novelty device of this invention, when inflated, is able to maintain a rigid body structure of low weight, while still exhibiting considerable flexibility when a more massive object contacts it. These characteristics together with the avoidance of sharp corners and sharp protrusions provides a novelty device which may safely be used in crowds.

Once inflated, the novelty device of this invention may be placed over the hand and may be waved, raised over the head, and because the hand cavity is comprised of flexible sheet material, the user may clap his hands without removal of the hand from the cavity area. In fact, a novelty device of this invention may be placed over each hand and the hands still clapped or used for other purposes, such as grabbing railings and the like or preventing falling. An attachment means may be provided to accommodate use of the inflated novelty device as a decoration.

Unlike promotional and sporting novelties of the prior art, when the novelty device of this invention is not in use, it may be deflated and may be easily folded to a convenient small package for storage until its next use. For example, when inflated, the sporting novelty of this invention may have dimensions of about 14×23 inches or larger and when deflated, may have dimensions of 6×7 inches or smaller in a flat package.

It is readily apparent that any sheet material which is non-previous to the inflation fluid may be used to fabricate the novelty device of this invention. Especially suitable are heat sealable polymeric materials such as polyethylene or polypropylene either by themselves or laminated to materials such as nylon or polyester. Generally, sheet materials having a thickness of about 0.001 to about 0.010 inch are suitable, depending upon the size of the sporting novelty.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An inflatable novelty device comprising; an inflatable body of generally inverted U shape having two legs joined by a joining member and defined by a front flexible sheet, a rear flexible sheet, a peripheral edge seal near the outer edge and an inner edge seal near the inner edge forming a single inflatable cavity; a single valve means in said inflatable body capable of communication between said single inflatable cavity and the exterior in an inflation mode; and said front and rear flexible sheets between said legs of said inverted U shape inflatable body forming a central non-inflatable body forming a central non-inflatable hand pocket having an open end for hand insertion into the hand pocket cavity formed thereby and said inflatable body peripheral thereto.

2. The novelty device of claim 1 wherein said peripheral inflatable body has at least one contiguous inflatable appendage extending outwardly therefrom.

3. The novelty device of claim 2 wherein said valve means is located in one of said outwardly extending appendages.

4. The novelty device of claim 1 wherein said peripheral inflatable body has one contiguous inflatable appendage extending outwardly therefrom.

5. The novelty device of claim 1 wherein said peripheral inflatable body has two contiguous inflatable appendages extending outwardly therefrom.

6. The novelty device of claim 1 wherein at least one of said flexible sheets forming said hand pocket has perforations therein providing ventilation of said hand pocket cavity.

7. The novelty device of claim 6 wherein each said front and said rear sheets forming said hand pocket has perforations therein providing ventilation of said hand pocket cavity.

8. The novelty device of claim 1 wherein said valve means comprises inflation-retention-deflation means capable of said communication between said inflatable cavity and the exterior in the inflation and deflation mode.

9. The novelty of claim 8 wherein said inflation-retention-deflation means is located in an outwardly extending appendage.

10. The novelty device of claim 9 wherein said inflation-retention-deflation means in a retention mode is enclosed in a pocket turned inside out over the closed portion to form a closure resistant to external forces.

11. The novelty device of claim 1 wherein said flexible sheets comprise polyethylene sheets and said seals are heat seals.

12. The novelty device of claim 1 wherein said inner seal is in the form of a glove at the edge facing said hand pocket cavity.

13. The novelty device of claim 1 wherein said flexible sheets comprise polypropylene sheets.

14. The novelty device of claim 1 wherein said flexible sheets have a thickness of about 0.001 to about 0.010 inch.

* * * * *